United States Patent [19]

Stubbings

[11] 4,270,445

[45] Jun. 2, 1981

[54] APPARATUS FOR BUNDLING AND BANDING A STACK OF OBJECTS

[75] Inventor: James H. Stubbings, Rockville, Md.

[73] Assignee: Potomac Applied Mechanics, Inc., Bethesda, Md.

[21] Appl. No.: 55,368

[22] Filed: Jul. 6, 1979

[51] Int. Cl.[3] ..... B65B 13/04

[52] U.S. Cl. ..... 100/4; 100/7; 100/26; 414/43; 414/97

[58] Field of Search ..... 100/2, 3, 7, 25, 26, 100/4; 414/43, 97

[56] References Cited

U.S. PATENT DOCUMENTS

| | | | |
|---|---|---|---|
| 2,844,091 | 7/1958 | Shafer | 100/25 |
| 3,280,725 | 10/1966 | Bartram | 100/25 X |
| 3,797,381 | 3/1974 | Glasson | 100/26 |
| 3,889,585 | 6/1975 | Morrow | 100/26 |
| 4,106,380 | 8/1978 | Stubbings | 83/212 |

*Primary Examiner*—Billy J. Wilhite

*Attorney, Agent, or Firm*—Cushman, Darby & Cushman

[57] ABSTRACT

Apparatus for bundling and banding elongated objects such as angle irons. The objects fall between the walls of a U-channel shaped bundler which automatically stacks them. One or more retractable upper band guide structures then move over the bundler to enclose the stack of objects. A band is then fed around the objects against the bundler walls, base and upper guide structure by a banding assembly which also tightens and fastens the band securely around the objects. Rollers disposed on the bundler base and one wall permit the objects to be rolled off the bundler after banding is completed. Air pistons suitably provide all the necessary forces except rotation of the feeder which is electrically driven. The process is suitably controlled by computer or the like.

15 Claims, 6 Drawing Figures

APPARATUS FOR BUNDLING AND BANDING A STACK OF OBJECTS

BACKGROUND OF THE INVENTION

The present invention relates to an apparatus for bundling and banding a stack of objects, particularly of heavy elongated objects, such as angle irons and other structural members. The invention is particularly useful in combination with a device which operates on the objects, e.g., cuts the objects into uniform lengths, and from which the objects may be caused to fall vertically into a stacking means. Such a device may, for example, be the angle iron cutting device disclosed in U.S. Pat. No. 4,106,380, the disclosure of which is hereby incorporated by reference herein.

Prior automatic or semi-automatic banding devices for banding large heavy objects require the objects to be prestacked and then slid horizontally as on rollers to a precise position beneath a fixed top of the banding device and beside a fixed side or sides of the device.

In accordance with the present invention, objects to be bundled and banded fall to the bottom of a U-shaped channel bundler structure through an open top, one side being horizontally adjustable in accordance with the size of the objects so that the objects are automatically stacked on top of each other as they fall. When a predetermined number of objects have been stacked, the objects are clamped from above by a clamping mechanism and banded without any further movement of the objects being required.

In accordance with the invention, the banding process commences with one or more upper guide structures moving over the top opening of the U-channel shaped bundler structure, thereby bridging the two side walls so that a continuous guided path for the banding is provided. A banding assembly (or a series of banding assemblies disposed along the length of the bundler structure) then bands the stacked objects together. In accordance with the preferred embodiment of the invention, a first side wall of the U-channel shaped bundler structure includes the banding assemblies, each one composed of conventional banding elements, which feeds band from a band spool around the inner peripheral surface of the bundler and through the feeder a second time, tensions the band about the objects, and fastens the band about the objects. A band cutter disposed adjacent to a band spool cuts the band. The band is guided in its path by a corresponding vertical groove in the opposite wall and horizontal groove on the bottom surface and spring steel finger members extending over the vertical side groove.

After fastening each banding assembly is moved longitudinally by a pneumatic piston arrangement to disengage the corresponding fastened band. In accordance with the preferred embodiment the clamping mechanism is then released and the bundler structure is rotated about a longitudinal axis by another pneumatic piston arrangement so that the banded objects are supported by transverse rollers disposed vertically in the opposite (second) side wall and horizontally in the base. In this way heavy banded objects may be more easily slid longitudinally from the bundler. The bundler structure is then rotated back to its upright position and the bridging upper guide means is retracted to that another group of objects may be stacked in the bundler and the process repeated.

In accordance with the preferred embodiment of the invention all of the power to the system, except electric motor driven continuously revolving parts, such as the feeder, is provided by pneumatic piston arrangements. Computer control means may provide for control and operation of all of the power means associated with the apparatus for truly automatic control of the banding and bundling operation until just a banded stack of objects is ready to be rolled away.

It is the primary object of the present invention to provide an apparatus for complete control of bundling and banding of objects such as angle irons or like. This and other objects of the invention will become clear from an inspection of the detailed description of the invention with reference to the accompanying drawings and from the appended claims.

DETAILED DESCRIPTION OF THE PREFERRED EMBODIMENT

Figure 1:
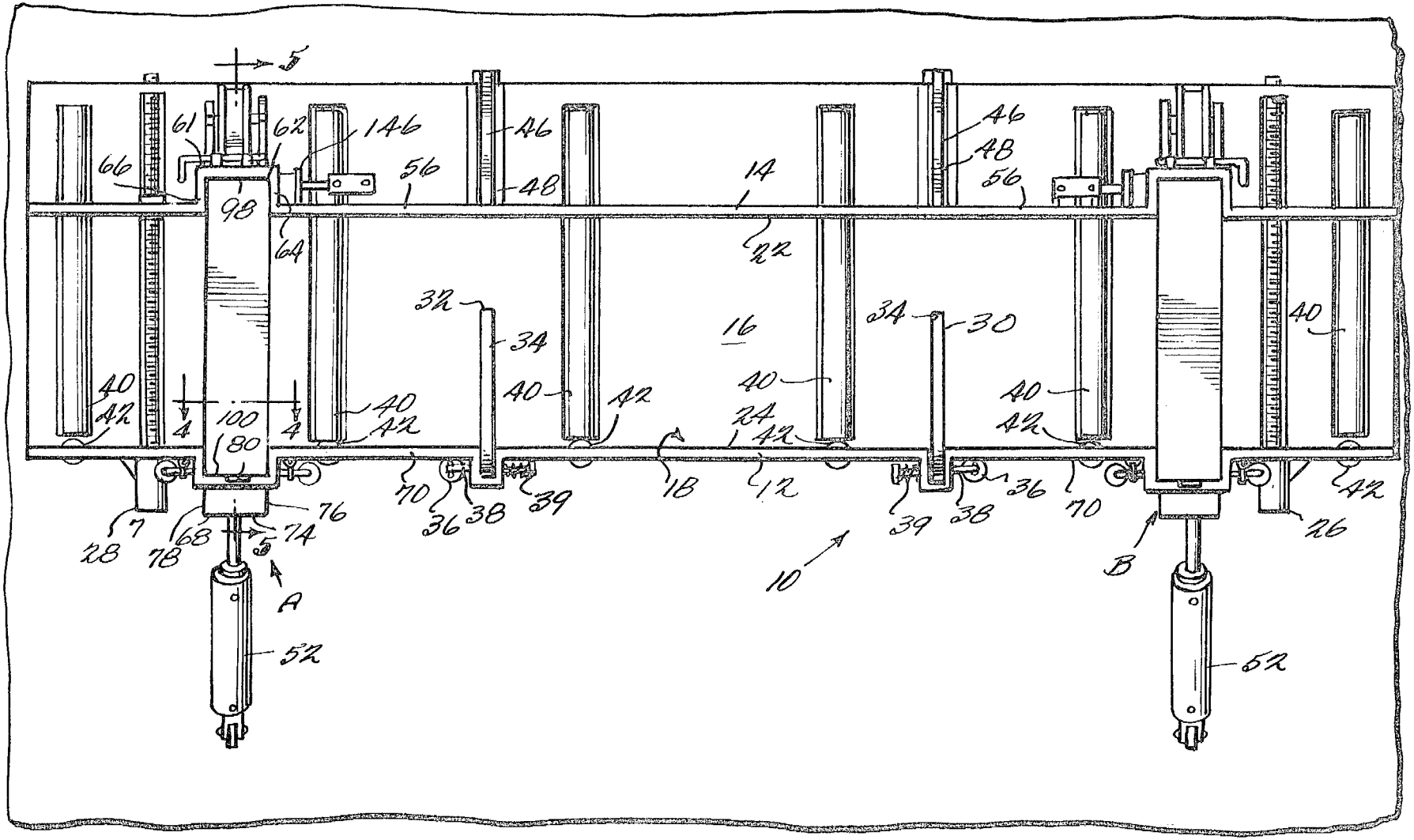
FIG. 1 is a plan view of the bridge portion of an exemplary bundler body structure according to the invention.
Figure 2:
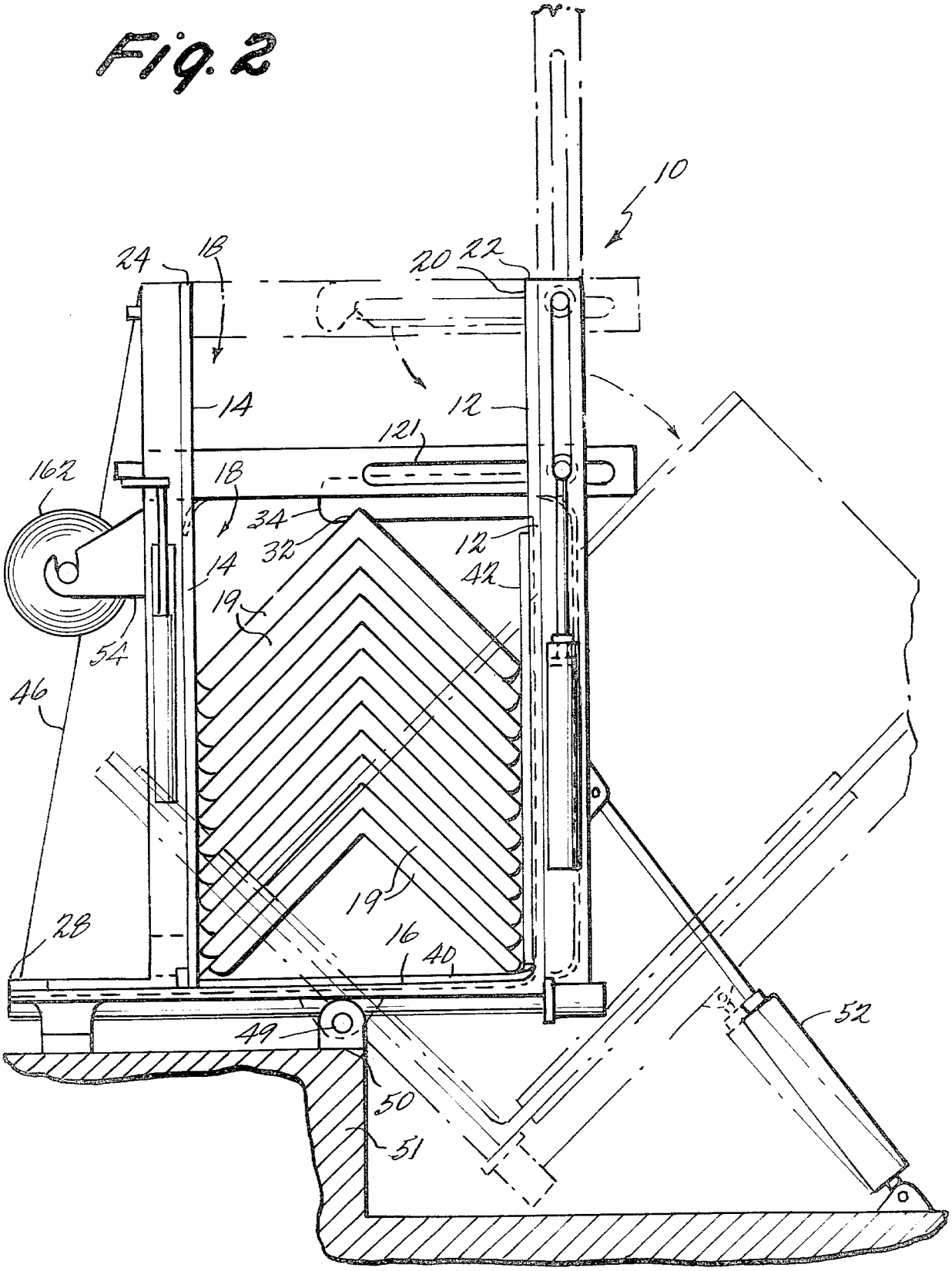
FIG. 2 is an end elevation view of an exemplary bundler body structure according to the invention.

Referring first to FIGS. 1 and 2, there are shown plan and end views of an exemplary bundler structure 10 suitable for bundling angle irons and other structural steel parts. Bundler 10 has an extended U-channel shape including parallel vertical walls 12 and 14 and base 16, wall 12 and base 16 suitably consisting of a single steel piece. Walls 12 and 14 and base 16 define a space 18 wherein elongated objects such as structural steel parts, typically angle irons 19, may fall one on top of the other in stacked relation through opening 20 defined by upper side edges 22 and 24. Means are provided for adjusting the distance between walls 12 and 14. In accordance with the present embodiment, by adjusting screw means 26 and 28, disposed at opposite ends of bundler 10, and engaging the bottom edges of walls 12 and 14, wall 14 may be moved toward and away from wall 12 so that the width of channel 10 may be adjusted in accordance with the width of the objects to be bundled and banded. Clamps 30 and 32, mounted to wall 12, clamp the objects to be banded during banding. Clamps 30 and 32 suitably comprise clamping bar members 34 which may be moved vertically downward on vertical member 36 by power means (not shown) during clamping and may be rotated downward about an axle 38 parallel to edges 22 while the objects to be bundled and banded are falling into bundler 10. Clamping members 34 are typically rotationally spring loaded about their longitudinal axes toward the horizontal by springs 39. When an object 19 falls into bundler 10 across edge 22, members 34 are pivoted downward by the falling objects and are returned automatically to the horizontal by spring 39.

When the objects to be banded fall into bundler 10, they are supported by rollers 40 disposed on base 16. Rollers 42 are vertically disposed on wall 12. Wall 14 is suitably vertically supported by right triangular gussets 46 vertically fixedly mounted to side 14 along wall edges 48 and slidably mounted to base 16. (See FIG. 3.) Bundler 10 is suitably pivotally mounted on an axle 49 which is mounted at the edge 50 of a stepped base 51 and pivotally supported by air piston 52 so that bundler 10 may be tilted during removal of the stacked objects after they have been bundled and banded.

In accordance with the preferred embodiment of the invention, means for banding a number of bands about the objects are disposed along the length of the bundler, for example, at positions A and B. For simplicity of explanation only one such means (at position A) is described although two or more such means would normally be provided where elongated objects are to be banded.

Figure 5:
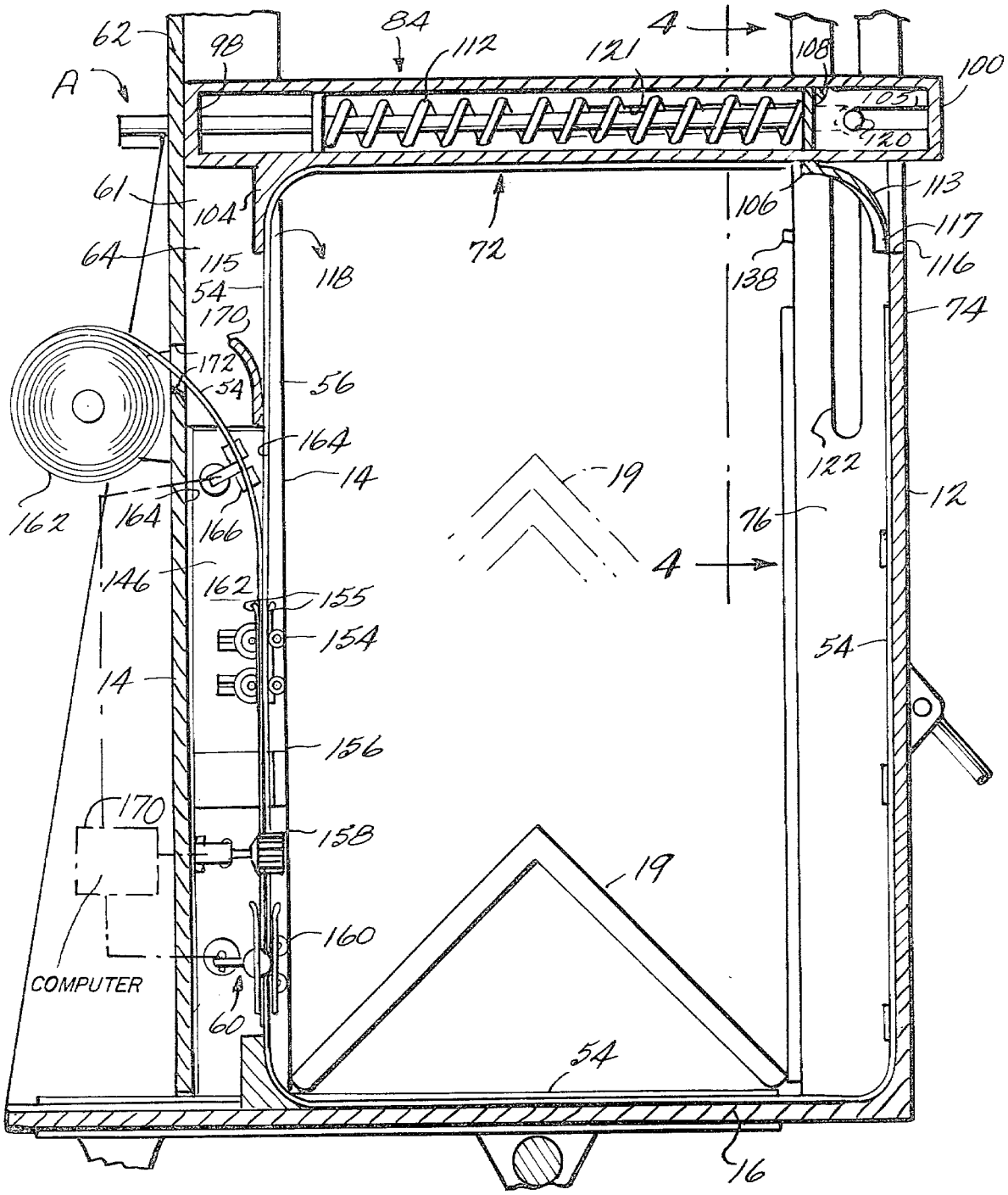
FIG. 5 is an enlarged cross-sectional view of the apparatus taken along the line 5—5 in FIG. 1.

Referring to FIG. 1, at position A, guide means are provided for releasably guiding a band 54 in a peripheral path down vertical wall 14, along base 16 under the objects to be banded 19, up side wall 12, across space 18 and part way down side wall 14 again to complete a path around the objects to be banded. As is shown in FIG. 5, at position A, side wall 14 is indented outwardly in rectangular cross-section from its main portion 56 for partially housing, out of the way of the objects 19, a banding arrangement 60 which feeds, fastens and cuts band 54 as will be described. Referring back to FIG. 1, the indented portion 61 of wall 14 includes a front wall 62 and side walls 64 and 66. Wall 12 also includes at position A an indented portion 68 which extends outwardly from the main portion 70 in rectangular cross-section in order to house—out of the way of the objects 19 while objects 19 are falling into bundler 10—a retractable upper guide structure 72 as will be described. Indented portion 68 includes a rear wall 74 joined to wall portion 70 by parallel side walls 76 and 78.

Figure 6:
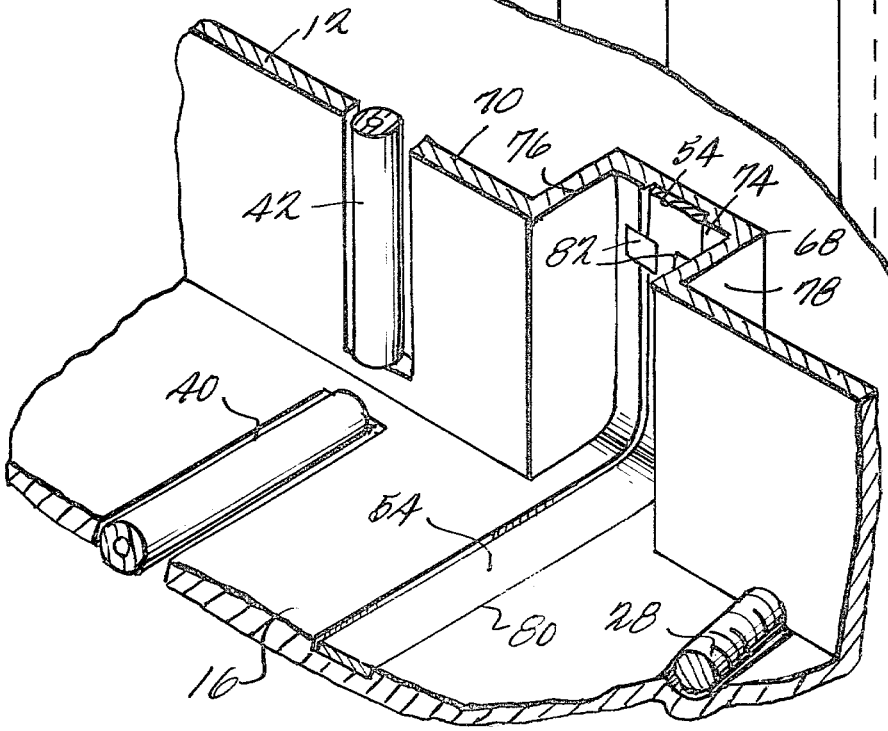
FIG. 6 is an enlarged perspective view of a portion of the bundler walls of the present invention.

As is best shown in FIG. 6, band 54 is guided along base 16 and rear wall 74 in a transverse groove 80, the groove being rounded at the intersection of base 16 and wall 74. Spring steel fingers 82 are suitably mounted across the edges of groove 80 on wall 74 in order to retain the band 54 therein.

Figure 4:
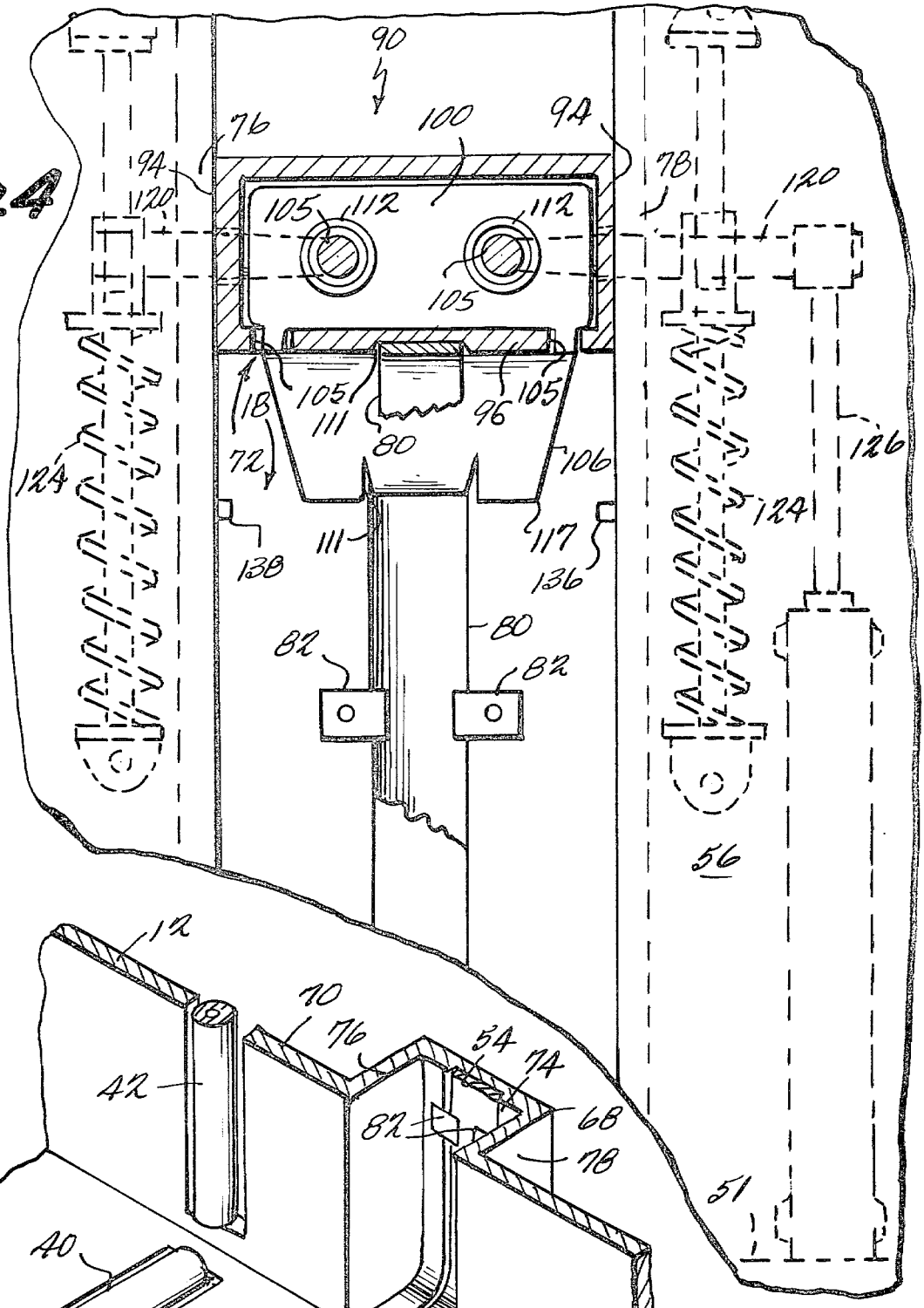
FIG. 4 is a sectional view taken along lines 4—4 in FIGS. 1 and 5.

In order to continue the guide path across space 18, retractable upper guide structure 72 is removably disposed at position A between front wall 62 and rear wall 74 as is best illustrated in FIGS. 4 and 5. In accordance with one aspect of the invention, upper guide structure 72 is slidably and pivotally mounted at wall 12 and vertically supported at wall 14 such that it may be retractably pivoted over space 18 when the objects to be banded have been received therein. In accordance with this aspect of the invention, guide structure 72 includes a hollowed out rectangular box-shaped structure 90 having sides 94, a bottom 96 and ends 98 and 100. A fixed curved plate 104 extends downward and curves inward from the bottom surface of bottom 96 of box 90 near end 98. Bottom 96 has longitudinal slots 105 along the longitudinal sides thereof extending from end 100 to a position short of plate 104. A pair of slide rods 105 parallelly extend in a horizontal plane from end 98 to end 100. Plate 106 is horizontally slidably spring mounted on rods 102 and has a rectangular upper portion 108 the bottom edge of which terminates in a slot 110 through which passes bottom 96. Beneath slot 110, plate 106 includes a curved portion 113 which extends downward and curves inward with the opposite curvature of plate 104. A groove 111 extends in alignment with groove 80 from the lower tip of plate 105, across bottom 96, to the bottom tip 115 of plate 104, so as to guide therein band 54. The lip of plate 106 has a knife edge 117 so that band 54 will not encounter interference when fed across this tip from groove 80 in wall 74 as will be described.

Compression springs 112 are mounted about rods 102 between plate 106 and a fixed transverse plate 114 vertically mounted in box 90 above plate 104 so as to urge plate 106 away from plate 104. As is illustrated in FIG. 5, upper guide structure 72 may extend transversely across space 18, with end 98 abutting front wall 62 and end 100 extending through an opening 116 in rear end 100. In this position, springs 112 urge knife edge 111 of plate 106 against wall 74 and end 98 against wall 62.

Figure 3:
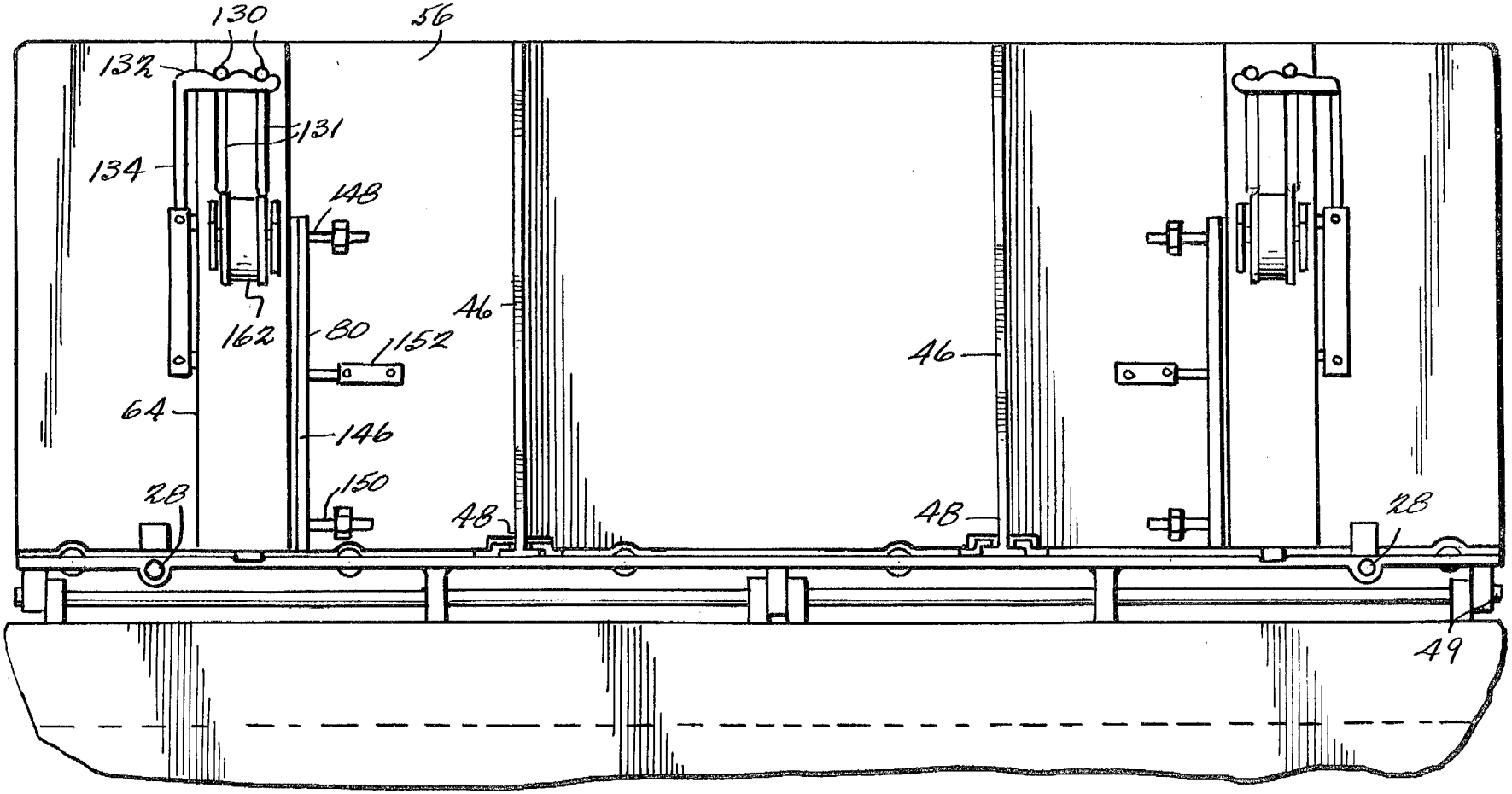
FIG. 3 is a front elevation view of the bundler apparatus of FIGS. 1 and 2.

Referring to FIG. 4, in order to provide vertically adjustable support for guide structure 72 adjacent to wall 12 indentation 68, handles 120 extend from opposite sides of plate 108 through slots 121 in sides 94 adjacent end 100 through respective vertical slots 122 in side walls 76 and 78, to vertically supporting tension springs 124 and air piston 126 which are respectively fixedly mounted to wall 12 main portion 56 and base 51. In order to provide vertically adjustable support for guide structure 72 adjacent the indentation 61 of wall 14, handles 130, which extend outwardly from end 98 of box structure 90 through vertical slots 131 in wall 74, rest on a platform 132 which is mounted at one end to a supporting air piston 134 vertically mounted to side wall 64 as is illustrated in FIG. 3. Respectively mounted to the inside faces of walls 76 and 78 are axially aligned fulcrum rods 136 and 138. By actuating air piston 126 to pull downward on pivotable handles 120, upper guide structure 74 is caused to pivot about fulcrum rods 136 and 138 into a vertical orientation fully disposed in wall indentation 68 so as to be out of the way of objects 19 when they fall into bundler 10 as described above.

Other retractable means for guiding banding across opening 20 as will be apparent to those of ordinary skill in the art is contemplated by the present invention.

Referring to FIGS. 3 and 5 the banding arrangement 60 is mounted on a frame 146. Frame 146 is slidably supported by rods 148 and 150 mounted horizontally and parallel to wall 56 for movement longitudinally of the bundler 10. Means for moving frame 146 along rods 148 and 150 is slidably provided by a piston 152 mounted to wall 56. Banding arrangement 60, which includes band feeder 154 having guide bands 155, fastener dispenser 156, fastener 158 and band tightener 160, is mounted to vertical face 162 of frame 146 and extend through opening 164 in wall 64 into vertical alignment with the grooved portion of tip 115 of curved plate 104. In this alignment, the banding arrangement is disposed just inside recessed wall portion 61 so that the objects to be banded may be stacked immediately adjacent to the portion of band 54 held by banding arrangement 60 and the slack in band 54 around the stack of objects 19 after banding is thereby limited to a minimum amount. Band spool 162 is mounted to the exterior face of front wall 62 and feeds band 56 through a slot 164 in front wall 62 through a band cutter 166 mounted to frame 146 and to band feeder 154. The band spool 162, band cutter 166, and the elements of banding arrangment 60, band feeder 154, fastener dispenser 156, fastener 158 and band tightener 160 are typically conventional banding apparatuses such as those manufactured by Signode Corporation, Chicago, Illinois. A curved guide plate 170 is mounted to wall 64 above feeder guide bands 155 in alignment with feeder guide bands 155 and tip 111 of curved plate 104 so as to provide lateral guidance to the band between curved plate 104 and band feeder 154.

In accordance with the operation of the invention, band 54 on spool 162 is fed through wall opening 172 to cutter 166 and through feeder guide bands 155 and feeder 154, fastener dispenser 156, fastener 158 and tightener 160. The band 54 is then guided under the objects to be banded and upward along wall 12 in groove 52. The band 54 is then guided across the opening of bundler 10 by groove 80 in curved plate 113, undersurface 96 of box 90 and curved plate 104. Band 54 is then guided downward across curved plate 170 to re-enter guide bands 155 of feeder 154. When the leading end of the band 54 has passed through fastener dispenser 156, fastener 158 and band tightener 160 for a second time, tightener 160 may be energized to pull the band away from grooves 80 and 111 and tightly around the objects to be banded (not shown). Fastener dispenser 156 and fastener 158 are then caused to operate in a conventional manner to fasten the band. Cutter 166 then cuts the band. After the band 54 has been cut, air piston 152 is energized to longitudinally move frame 146 so that feeder 154, fastener dispenser 156, fastener 158 and banding tightener 160 are drawn out of engagement with the band surrounding the stack of objects. Bundler 10 is then rotated about longitudinal axle 49 so that the banded objects 19 are supported by both base rollers 40 and side wall rollers 42 for ease of removal of the banded objects in a longitudinal direction. Following removal of the banded objects, the bundler may be returned to its upright orientation and upper guide structure 72 is retracted so that additional objects 19 may enter the bundler 10.

All the operations of receiving the objects for stacking in the bundler, banding the stacked objects and pivoting the bundler for ease of removal of the banded objects may, in accordance with the present invention, be controlled by a computer 170 or the like, shown schematically in FIG. 5. The same computer control can be utilized as is provided for the angle iron cutting and punching operations when the invention is utilized with the angle iron cutting assembly disclosed in U.S. Pat. No. 4,106,380 (the disclosure of which is hereby incorporated by reference herein). The bundler structure 10 can be disposed just below the collapsible shelf support or the like (108 in U.S. Pat. No. 4,106,380) of the angle iron cutting assembly.

Suitably, all of the required movements may be powered by air pistons with the exception of continuous rotary power such as is required for feeder 130.

The following steps are performed in accordance with a method for utilizing the apparatus for bundling and banding a plurality of objects:

1. A plurality of objects are first dropped one by one to form a vertical stack in the bundler structure;

2. The objects are clamped in the bundler structure;

3. The retractable upper band guide means is moved across the top of the bundler structure;

4. At least one metal band is fed around the interior periphery of the bundler structure, including the underside of the upper band guide means, to encircle the objects to be banded;

5. The band or bands are tightened around the objects;

6. The band is fastened around the objects and the band cut so that the banded objects may be freely removed from the bundler; and 7. The banded objects are removed from the bundler structure and the upper guide means retracted so that another stack of objects to be banded may be provided to the bundler structure.

While the invention has herein been shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent apparatus and structures.

What is claimed is:

1. An apparatus for bundling and banding objects together comprising:

a bundler structure including a base and first and second opposing side walls having opposing inside surfaces extending upward from the inside surface of said base, said side walls having upper edges defining an opening for vertically receiving said objects onto said base at a first position on said base, said base and side walls having means for releasably guiding at least one band downward along the inside surface of one of said walls, beneath said objects to be banded and upward along the inside surface of the other of said walls when said objects are in said first object position; and bridge means for guiding said at least one band across said opening;

means, connected to said bridge means, for moving said bridge guide means between a first guide position whereat said guide means extends substantially across said opening in spaced relation to said base in planar alignment with said wall and releasably guiding means and a second guide position removed from at least one of said two side walls whereat said objects may be vertically received through said opening at said first object position;

said first side wall including banding means for banding said objects together including means for feeding said at least one band along said base and side walls and along said bridge guiding means to complete a planar path about said objects to be banded;

tightening means for releasing said at least one band from said releasable guide means and tightening said at least one band about said objects to be banded;

said side surface upper edges being parallel aligned and defining a longitudinal direction, and wherein the bundler structure is open-ended;

said walls and base being pivotable about an axis parallel to said longitudinal direction into a tilted position so that said objects to be banded may be jointly supported by said base and said second side wall;

said base further including first roller means for rolling said objects in said longitudinal direction thereon, out an open end; and said second side wall further including second roller means for rolling said objects in said longitudinal direction thereon, out an open end.

2. An apparatus as in claim 1 further comprising means for adjusting the distance between said two side walls.

3. An apparatus as in claim 1 wherein said base and side wall guide means include at least one vertical groove in said second side wall and a horizontal groove in said base, for receiving said at least one band therein;

and spring mounted finger members extending over said at least one vertical groove for releasably retaining said at least one band in said groove.

4. Apparatus as in claim 1 further comprising actuatable means for pivoting said two side walls and base about said axis between a first position in which said objects are totally supported by said base, and said tilted position.

5. An apparatus as in claim 1 wherein said banding means further includes means for fastening said at least one band after said band has been tightened about said objects; and means for cutting said band after said band has been fastened so that said objects may be removed from said bundler and a next plurality of objects may be banded.

6. Apparatus as in claim 5 further comprising means, pivotably and vertically slidably mounted to said second side wall, for clamping said objects during banding such that said means pivots downward when said bundler is receiving said objects and slides downward to clamp said objects together during said banding.

7. Apparatus as in claim 6 further comprising computer control means or the like for controlling said bridge means moving means, said clamping means, said feeding means, said tightening means, said fastening means, said cutting means and said side and base pivoting means in successive order to bundle and band said objects and remove the banded and bundled objects from said bundler.

8. Apparatus as in claim 6 wherein said moving means, said bridge means moving means, said clamping means, said feeding means, said tightening means, said fastening means, said cutting means and said side and base pivoting means each include a corresponding air piston said control means being coupled thereto.

9. Apparatus as in claim 1 further comprising means for displacing said banding means in a longitudinal direction so that said banding means may be disengaged from the band after the band has been fastened to the objects to be fastened.

10. A bundler structure comprising a base and first and second opposed parallel side walls, said structure being open on top and on at least one end;

first roller means mounted with said base for rolling objects disposed in said structure out through said at least one open end;

second roller means mounted with said second side wall for rolling objects disposed in said structure out through said at least one open end;

means for mounting said structure for pivotal movement about an axis parallel to a plane containing one of said side walls so that said second side wall is movable from a position wherein it is substantially vertical to a position wherein it makes a positive angle of less than about 90° with respect to the vertical, and is below opposite portions of said first wall; and means for mounting said first wall for movement along said base with respect to said second wall, so that said first wall remains parallel to said second wall.

11. A structure as recited in claim 10 further comprising banding means mounted with said first side wall; and bridge means pivotal about an axis parallel to one of said side walls for movement from a position wherein it bridges said open top of said structure to a position wherein it does not cover said open top, said bridge means providing a guiding structure for metal band from said banding means for encircling objects contained between said side walls.

12. A structure as recited in claim 11 further comprising a horizontal groove formed in said base and perpendicular to a plane containing one of said side walls, and a vertical groove formed in said second side wall, each of said grooves dimensioned to receive a metal band from said banding means therewithin, and said grooves in operative alignment with said bridge means.

13. An apparatus for bundling and banding objects together comprising:

a bundler structure including a base and first and second opposing side walls having opposing inside surfaces extending upward from the inside surface of said base, said side walls having upper edges defining an opening for vertically receiving said objects onto said base at a first position on said base, said base and side walls having means for releasably guiding at least one band downward along the inside surface of one of said walls, beneath said objects to be banded and upward along the inside surface of the other of said walls when said objects are in said first object position; and bridge means for guiding said at least one band across said opening;

means, connected to said bridge means, for moving said bridge guide means between a first guide position whereat said guide means extends substantially across said opening in spaced relation to said base in planar alignment with said wall and releasably guiding means and a second guide position removed from at least one of said two side walls whereat said objects may be vertically received through said opening at said first object position;

said first side wall including banding means for banding said objects together including means for feeding said at least one band along said base and side walls and along said bridge guiding means to complete a planar path about said objects to be banded;

tightening means for releasing said at least one band from said releasable guide means and tightening said at least one band about said objects to be banded; and means for adjusting the distance between said two side walls.

14. An apparatus for bundling and banding objects together comprising:

a bundler structure including a base and first and second opposing side walls having opposing inside surfaces extending upward from the inside surface of said base, said side walls having upper edges defining an opening for vertically receiving said objects onto said base at a first position on said base, said base and side walls having means for releasably guiding at least one band downward along the inside surface of one of said walls, beneath said objects to be banded and upward along the inside surface of the other of said walls when said objects are in said first object position; and bridge means for guiding said at least one band across said opening;

means, connected to said bridge means, for moving said bridge guide means between a first guide position whereat said guide means extends substantially across said opening in spaced relation to said base in planar alignment with said wall and releasably guiding means and a second guide position removed from at least one of said two side walls whereat said objects may be vertically received through said opening at said first object position;

said first side wall including banding means for banding said objects together including means for feeding said at least one band along said base and side walls and along said bridge guiding means to complete a planar path about said objects to be banded;

tightening means for releasing said at least one band from said releasable guide means and tightening said at least one band about said objects to be banded; and means for displacing said banding means in a longitudinal direction so that said banding means may be disengaged from the band after the band has been fastened to the objects to be fastened.

15. An apparatus for bundling and banding objects together comprising:

a bundler structure including a base and first and second opposing side walls having opposing inside surfaces extending upward from the inside surface of said base, said side walls having upper edges defining an opening for vertically receiving said objects onto said base at a first position on said base, said base and side walls having means for releasably guiding at least one band downward along the inside surface of one of said walls, beneath said objects to be banded and upward along the inside surface of the other of said walls when said objects are in said first object position; and bridge means for guiding said at least one band across said opening;

means, connected to said bridge means, for moving said bridge guide means between a first guide position whereat said guide means extends substantially across said opening in spaced relation to said base in planar alignment with said wall and releasably guiding means and a second guide position removed from at least one of said two side walls whereat said objects may be vertically received through said opening at said first object position;

said first side wall including banding means for banding said objects together including means for feeding said at least one band along said base and side walls and along said bridge guiding means to complete a planar path about said objects to be banded;

tightening means for releasing said at least one band from said releasable guide means and tightening said at least one band about said objects to be banded; and means, pivotably and vertically slidably mounted to said second side wall, for clamping said objects during banding such that said means pivots downward when said bundler is receiving said objects and slides downward to clamp said objects together during said banding.

* * * * *